United States Patent [19]

Berlin et al.

[11] 3,951,069

[45] Apr. 20, 1976

[54] METHOD OF PAYLOAD DELIVERY AT LOW ALTITUDE

[75] Inventors: Aaron S. Berlin, Wilmington, Del.; Vincent C. Little, Fallston, Md.

[73] Assignee: The United States of America as represented by the Secretary of the Army, Washington, D.C.

[22] Filed: Feb. 21, 1974

[21] Appl. No.: 444,579

Related U.S. Application Data

[60] Continuation of Ser. No. 163,201, July 16, 1971, abandoned, which is a division of Ser. No. 757,298, Sept. 4, 1968, Pat. No. 3,618,524.

[52] U.S. Cl. ..... 102/70.2 R; 89/1.5 R

[51] Int. Cl.[2] ..... F42C 15/12

[58] Field of Search ..... 89/1.5 D, 1.5 C, 1.5 A, 89/1.5 R, 1 B; 102/70 R, 70.2 R

[56] References Cited

UNITED STATES PATENTS

| | | | |
|---|---|---|---|
| 2,575,071 | 11/1951 | Rockwell | 89/1 B |
| 3,101,055 | 8/1963 | Kuntz et al. | 89/1.5 D |
| 3,319,521 | 5/1967 | Semenoff | 89/1.5 D |
| 3,416,451 | 12/1968 | Hamerla | 102/70 R |

*Primary Examiner*—Samuel Feinberg
*Assistant Examiner*—C. T. Jordan
*Attorney, Agent, or Firm*—Nathan Edelberg; Robert P. Gibson; Kenneth P. Van Wyck

[57] ABSTRACT

A method of assembling munitions and delivering a payload within a munition to a target area at low altitude wherein the energy source for arming the fuze is self contained within the mechanism and utilized subsequent to release of the munition from the delivery means.

2 Claims, 4 Drawing Figures

INVENTORS
Aaron S. Berlin
Vincent C. Little
Harry M. Saragovitz
Edward J. Kelly
Herbert Berl
Bernard J. Ohlendorf
BY ATTORNEYS INVENTORS
Aaron S. Berlin
Vincent C. Little
Harry M. Saragovitz
Edward J. Kelly
Herbert Berl
BY Bernard J. Ohlendorf
ATTORNEYS

METHOD OF PAYLOAD DELIVERY AT LOW ALTITUDE

DEDICATORY CLAUSE

The invention described herein may be manufactured, used, and licensed by or for the Government for governmental purposes without the payment to us of any royalty thereon.

This application is a continuation application of our pending U.S. Pat. application Ser. No. 163,201 filed 16 July 1971, now abandoned, which in turn was a divisional application of U.S. Pat. application Ser. No. 757,298 filed 4 Sept. 1968, now U.S. Pat. No. 3,618,524.

Our invention relates to a method for delivering a payload within a munition at low altitude.

The prior art fuzes, methods and systems were designed to utilize long arming wires or were of the air arming type such as disclosed in U.S. Pat. No. 2,737,118. Such prior art devices on occasion damaged the aircraft due to the wires which were required, and the prior art devices could not be used for low altitude delivery. Our invention was conceived and reduced to practice to overcome these disadvantages and problems.

A principal object of our invention is to provide a reliable method for delivering a payload from munitions at low level, 50 feet and less.

Another object of our invention is to provide a reliable method for arming munitions for low level delivery which is economical, safe to use, and will not cause aircraft damage.

A further object of our invention is to provide a reliable method for arming munitions for low level delivery wherein the energy for arming the fuze is self contained and utilized subsequent to the release of the munition from the delivery means.

Other objects of our invention will be obvious or will appear from the specification hereinafter set forth.

Figure 2:
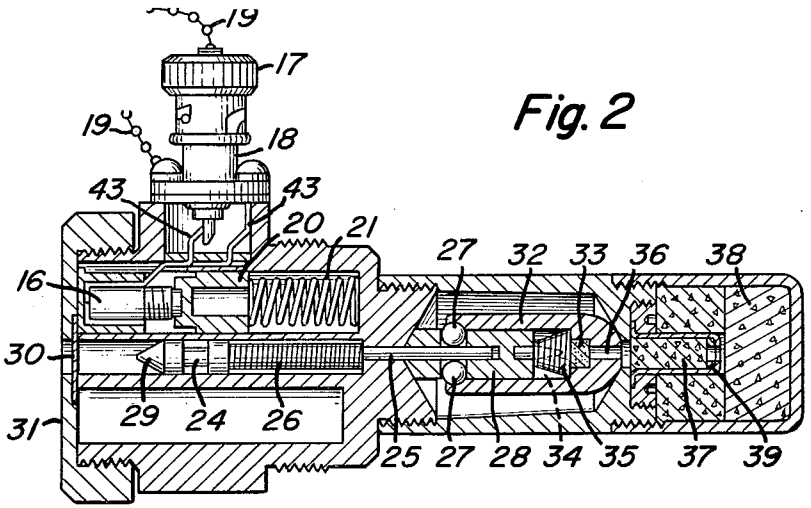
FIG. 2 is a sectional view of our fuze.
Figure 1:
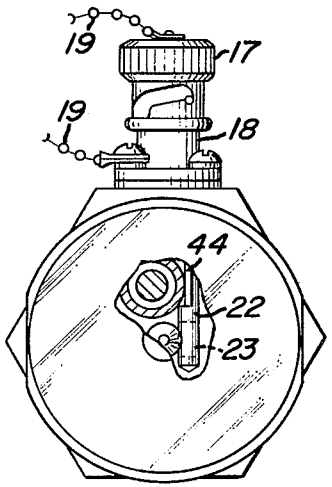
FIG. 1 is an end view of FIG. 2 of our fuze cut away to show the cam release mechanism.
Figure 3:
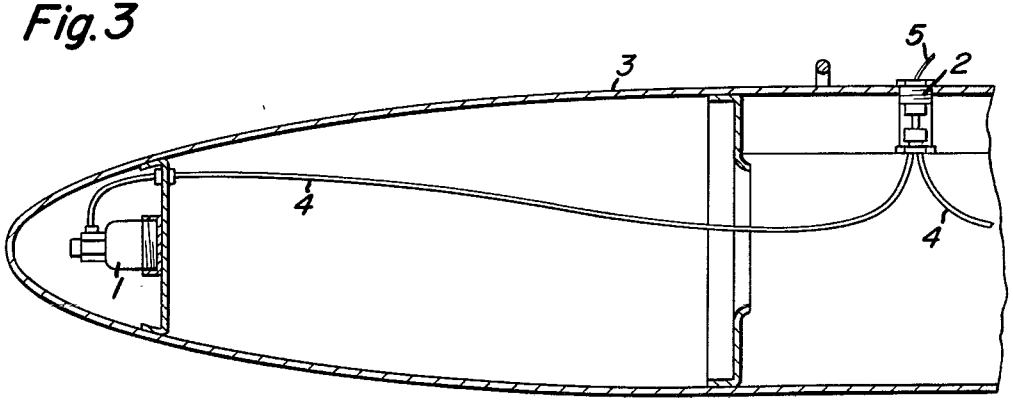
FIG. 3 is a view showing the utility of our fuze and initiator in a munition.
Figure 4:
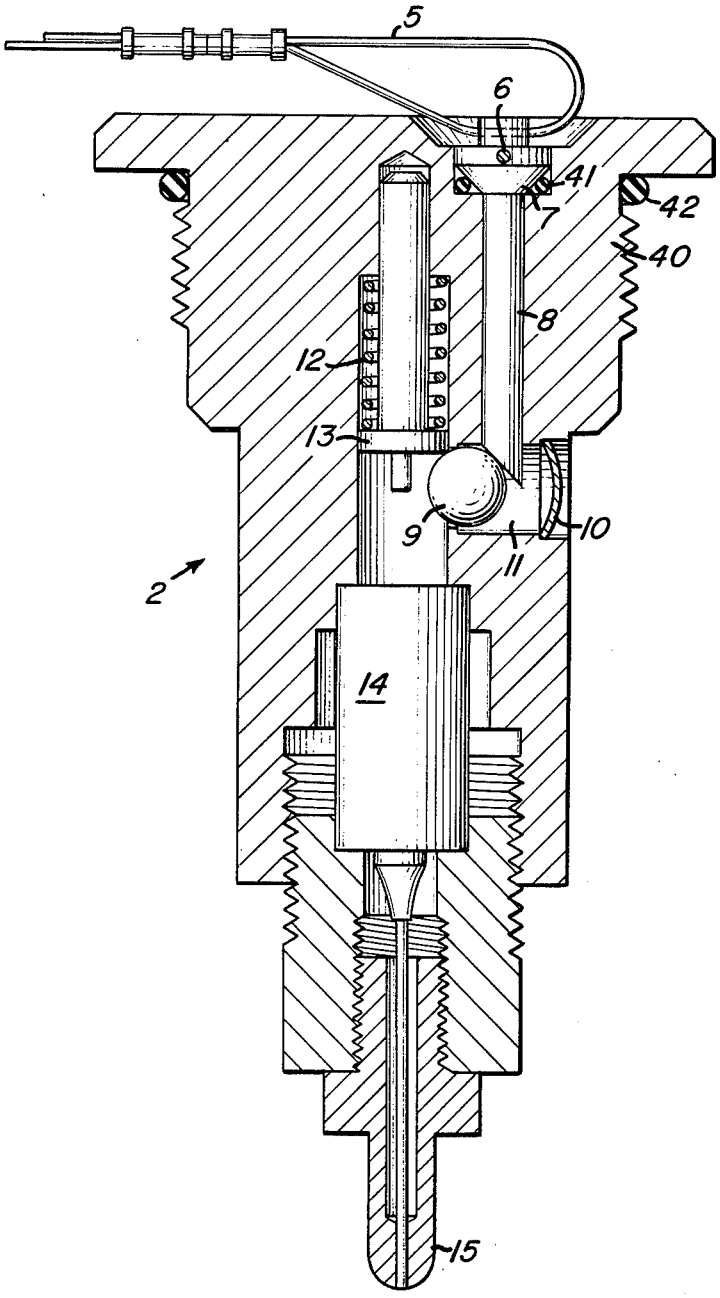
FIG. 4 is a sectional view of the initiator of our fuze.

Our invention as shown in FIGS. 1 to 4 will now be described in detail as follows. Fuze 1, as shown in FIGS. 1 and 2, and initiator 2, as shown in FIG. 4, are fixedly mounted in munition housing 3 by any conventional means, such as thread means, as shown in FIG. 3. While FIG. 3 shows connector wires 4 which are either standard type or shielded, depending upon the particular application, leading from the initiator to two fuzes, the initiator can be modified within the skill of the art to connect to any number of fuzes as required. After the fuze and initiator are mounted, the munition is placed onto a rack on the underside of an aircraft, not shown in the drawing, in the conventional manner, such as storing bombs in a bomb bay and/or wings of an aircraft, and lanyard 5 is fixedly connected to the rack. While delivery of a munition from an aircraft is described, our fuze and initiator can be utilized for conventional ground emplacement statically fired projector means such as mortars, cannons, rocket launchers, or any other weapon system having any number of important tactical capabilities. The munition may be utilized to deliver food supplies, medicinal supplies, explosive composition, incendiary composition, marker flares, or any type of incapacitating agent. When the target area is reached, safety pin 6 is manually removed in the manner of a conventional grenade safety pin, and the munition, such as a bomb, is released from the aircraft munition rack by activating the release triggering means, not shown in the drawing, in the conventional manner. Upon munition 3 falling from the aircraft, lanyard 5 is drawn taut and extracts staked cap 7, retained in body 40 by any mechanical means, such as staked, and releases locking pin 8. Release of the locking pin permits ball 9 to be pushed toward closure 10, which is any conventional closure means such as a threaded plug, etc. to close off chamber 11 after ball 9 has been inserted therein during assembly, due to pressure exerted by spring 12. Firing pin 13 is then released and strikes a primer, not shown in the drawing, fixedly mounted in the top of conventional thermal battery 14. Striking of the primer ignites a conventional fuze delay within the battery, not shown in the drawing, which in turn activates the battery. The voltage of the battery and amount of time delay for the battery delay fuze is designed within the skill of the art to meet the requirements of each particular application. Battery 14 is case grounded, and the other battery lead is connected to electrical connector 15 in the conventional manner, such as soldering. Upon activation of battery 14, electrical energy is transmitted by means of electrical connector wire 4 to fuze 1, as shown in FIG. 3, in the conventional manner to arm the fuze. In particular, the electrical energy is transmitted to a conventional motor bellows 16, as shown in FIG. 2. FIG. 2 shows the fuze in the electrically disconnected state having a conventional twist lock dust cap 17 installed. To electrically connect the fuze, dust cap 17 is simply removed and connector wire 4 connected to the fuze electrical input 18 by a conventional twist lock connector attached to the end of wire 4. Loss of cap 17 is avoided by means of chain 19 fixedly attached to the fuze body. Upon supplying electrical energy to bellows 16 through wires 43, any conventional material, for producing gas upon ignition, within the bellows is ignited to produce a quantity of gas which expands bellows 16 and causes piston 20 to move downward as a result of depression of spring 21. Downward movement of piston 20 causes half cam 22, having cam notches 23 and 44 offset at 90, as shown in FIG. 1, to rotate and move cam notch 23 out of locking engagement with arming pin notch 24. The cam disengagement permits arming pin 25 to be released upward as a result of expansion of arming spring 26. Upward release of the arming pin permits balls 27 to fall within capsule 28 and point 29 to rupture foil 30 which is cemented in top 31. Rupture of foil 30, which is visible on viewing top 31 and can be any frangible metal, is a visual indicator that the fuze is armed. Prior to release of balls 27 within capsule 28, the balls are forced outward by pin 25 and retained within an annular ridge in the top of container 32 as shown in FIG. 2. Release of balls 27 permits capsule 28 to float freely within capsule container 32, but free floating detonation of the primer, not shown in the drawing, in primer detonator 33 by striker 34 is avoided by weak spring 35. However, the spring 35 tension is not sufficient to avoid striker 34 activating the primer on impact of fuze 1 with the target. Flash type detonator 37 is cushioned by annular felt disc 39. On activation of conventional primer detonator 33, flame is transmitted through chamber 36 to ignite conventional flash type detonator 37. Ignition of flash type detonator 37 in turn ignites and disperses payload 38, which can be an explosive mix, incendiary mix, marker flare, or any type of incapacitating agent mixed with explosive mix for dissemination as described above. In the case of food or medicinal supplies, a low level explosive charge just sufficient to separate the supplies from the munition is used. Structures 41 and 42 are any conventional sealing means, such as O rings, used to avoid moisture entering the initiator after assembly.

It is obvious that other modifications can be made of our invention, and we desire our invention to be limited only by the scope of the appended claims.

We claim:

1. A method of assembling and delivering a payload munition to a target comprising the steps of: providing a munition housing; providing a payload in the housing; mounting an electrically armed fuse means in said housing for impact activation and dissemination of the payload from the munition housing; affixing to said housing an initiator means having a safety pin means locking a lanyard activatable locking pin means in the unarmed position and having electrical energy means for connection to said fuse means; electrically connecting the electrical energy means to the fuse means for electrically arming said fuse means when the said safety pin means and the said locking pin means are sequentially removed whereby the removal of the locking pin means in turn ignites a primer on a conventional fuse delay to activate the electrical energy means; placing the electrically connected munition in a delivery means and attaching one end of a lanyard to the delivery means and the other end to the said locking pin means of said initiating means; removing the safety pin means to thereby enable the locking pin means to be removed by said lanyard; ejecting the munition from the delivery means towards the target and removing the said locking pin means by way of said lanyard thereby enabling the said electrical energy means to supply electrical current to the said fuse means; and activating the fuse means upon impact of said munition.

2. The method of claim 1 wherein said electrical energy means is a thermal battery.

* * * * *